United States Patent [19]

Beck

[11] 4,200,547

[45] Apr. 29, 1980

[54] MATRIX-BONDED PERMANENT MAGNET HAVING HIGHLY ALIGNED MAGNETIC PARTICLES

[75] Inventor: Edward D. Beck, Mendota Heights, Minn.

[73] Assignee: Minnesota Mining and Manufacturing Company, St. Paul, Minn.

[21] Appl. No.: 70

[22] Filed: Jan. 2, 1979

[51] Int. Cl.[2] ..... H01F 1/117; H01F 7/02

[52] U.S. Cl. ..... 252/62.54; 148/101; 264/DIG. 58; 335/303

[58] Field of Search ..... 252/62.54; 264/DIG. 58; 335/303; 148/101

[56] References Cited

U.S. PATENT DOCUMENTS

| | | | |
|---|---|---|---|
| 2,748,099 | 5/1956 | Bruner | 252/62.54 X |
| 2,849,312 | 8/1958 | Peterman | 252/62.54 X |
| 2,999,275 | 9/1961 | Blume | 252/62.54 X |
| 4,022,701 | 5/1977 | Sawa et al. | 252/62.54 |
| 4,028,255 | 6/1977 | Bolto et al. | 210/500 R |
| 4,116,906 | 9/1978 | Ishino et al. | 260/22 A |

FOREIGN PATENT DOCUMENTS 961257 1/1975 Canada .

*Primary Examiner*—F. C. Edmundson

[57] ABSTRACT

Matrix-bonded permanent magnet comprising anisotropic magnet particles which have an alignment exceeding 90%. The binder is a mixture of an amorphous hot-melt polyamide resin and a processing additive which is a cyclic nitrile derivative of a saturated fatty acid dimer.

7 Claims, No Drawings

MATRIX-BONDED PERMANENT MAGNET HAVING HIGHLY ALIGNED MAGNETIC PARTICLES

FIELD OF THE INVENTION

This invention relates to matrix-bonded permanent magnets comprising anisotropic, magnetically-hard particles in a nonmagnetic binder.

BACKGROUND OF THE INVENTION

The first anisotropic matrix-bonded permanent magnets were made by the process of U.S. Pat. No. 2,999,275 (Blume). In that process, a dispersion of domain-size ferrite platelets in a nonmagnetic binder is milled or extruded to align the faces of the platelets mechanically. The highly-filled magnet of Example 1 of the patent has a $B_r$ of 2100 gauss and a maximum energy product of $0.9\times10^6$ gauss-oersteds in the direction perpendicular of the faces of the aligned barium ferrite platelets.

U.S. Pat. No. 3,903,228 (Riedl) concerns a process for making improved barium ferrite platelets which by mechanical orientation provides a $B_r$ of 2690 gauss and a maximum energy product of $1.72\times10^6$ gauss-oersteds (Example 4). Canadian Pat. No. 961,257 dated Jan. 21, 1975 teaches that by combining magnetic orientation with the mechanical orientation and using improved ferrite platelets, a $B_r$ of 2800 gauss and a maximum energy product of $1.89\times10^6$ gauss-oersteds (Example 3) could be attained in a highly-filled magnet. The binder of Example 2 is a mixture of a thermoplastic, essentially amorphous, hot-melt polyamide resin having a softening point of 177° C. and a sulfonamide plasticizer.

Instead of milling or extruding, highly-filled matrix-bonded ferrite magnets may be formed by injection molding while applying a magnetic field to align the ferrite particles as in U.S. Pat. No. 4,022,701 (Sawa). Barium ferrite magnets made by this process exhibit a $B_r$ up to 2528 gauss and a maximum energy product up to $1.57\times10^6$ gauss-oersteds (Table 1), and for a strontium ferrite magnet a $B_r$ of 2680 gauss and a maximum energy product of $1.71\times10^6$ gauss-oersteds.

In the process of U.S. Pat. No. 4,022,701, a spherical or equal-axes particle would be preferred since platelets rotating in response to a magnetic field tend to mechanically interfere with each other. Samarium-cobalt magnet powders such as those of Example 4 of U.S. Pat. No. 4,022,701 tend to have equal axes and thus are especially suitable for magnetic alignment.

From a study of the above-discussed and other prior art, the only report we can find of a highly-filled (i.e., at least 60 volume percent) matrix-bonded permanent magnet wherein the particles have an alignment exceeding 90% is the aforementioned Canadian Pat. No. 961,257 (which was granted to the company to which the present application is assigned). We believe that the process of the Canadian patent has never been commercialized and that it could not on a commercially practical basis be used to produce highly-filled matrix-bonded magnets having a degree of particle alignment consistently exceeding 90%. The following formula gives an approximation of the degree of particle alignment in a matrix-bonded magnet:

$$B_r/(4\pi\sigma d)V$$

where $\sigma$ is the magnetic moment of the particles, d is the density of the particles and V is the volume percent of the particles in the matrix-bonded magnet.

The Present Invention

The present invention provides what are believed to be the first highly-filled matrix-bonded permanent magnets which can be produced on a commercially practical basis to achieve consistently a particle alignment exceeding 90%. In trial commercial-scale runs, particle alignment has been about 95%. Such high alignment can be attained at the high particle proportions needed to provide high magnetic values, that is, at least 60% by volume. In the aforementioned trial commercial runs, the particle proportion averaged about 63% by volume, and it is believed that particle alignment above 90% can be attained at a particle level as high as 70%. Preferably the particle proportion is 62 to 65% by volume since the particles are less free to turn in the magnetic field at higher proportions, especially if they are platelets.

Such achievements are provided by injection molding magnetically-hard, anisotropic particles and nonmagnetic binder into a die cavity while applying a magnetic field as in U.S. Pat. No. 4,022,701 except employing a nonmagnetic binder consisting essentially of a hot-melt polyamide resin which is essentially amorphous and has a ball-and-ring softening temperature of at least 50° C. and a small proportion of a processing additive which is a cyclic nitrile derivative of a saturated fatty acid dimer. This processing additive is essential to the attainment of a high degree of particle alignment and is effective in concentrations of 1–35% by weight of the total binder, preferably 3–15%.

A preferred hot-melt polyamide has the generalized formula

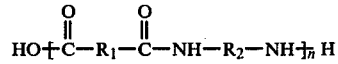

where $R_1$ is the residue of one or more dibasic acids, $R_2$ is the residue of one or more diamines and n is an integer such that the hot-melt polyamide has a ball-and-ring softening temperature of at least 50° C. Small percentages of the acid and amine residues may include additional carboxyl and amine functionality, respectively.

As pointed out in U.S. Pat. No. 4,022,701, the intensity of the magnetic field should be at least 3000 oersteds and sufficient heat should be applied during the injection molding so that the mixture of particles and binder is sufficiently fluid to permit it to fill the mold completely and to permit the particles to align with respect to the magnetic field while they are flowing into the mold. Preferably the mixture should be heated to the temperature at which the viscosity of the binder is about 100 poises or less. A binder viscosity of 100 poises should be attainable by heating the mixture about 15° C. or more above the ball-and-ring softening temperature of the binder while taking care not to raise the temperature above that at which either the hot-melt polyamide or processing additive would experience thermal degradation.

In tests with hot-melt polyamide alone as the binder, it was found that differences in binder viscosity within the range of 5 to 100 poises had little effect upon the resultant degree of particle alignment. In no event was particle alignment as high as 90% achieved. Even though the presence of the processing additive does reduce the binder viscosity, the high degree of particle orientation cannot be attributed to such reduction but is a result of some phenomenon which is not understood.

As compared to magnets produced by extrusion or milling, injection molding permits the magnets to have a far wider variety of sizes and geometrical configurations and preferred directions of magnetization. Because the mixture of particles and binder has relatively low shrinkage when cooled to room temperature from a molten state, the magnets of the present invention can be produced to close dimensional tolerances.

In the following examples, all parts are by weight unless otherwise indicated.

EXAMPLE 1

Barium ferrite platelets were prepared to have an average diameter of 1.9 micrometers, a surface area of 2.5–3.0 $m^2/g$ and a density of 5.28 $g/cm^3$. 90.16 parts (63% by volume) of the ferrite platelets were mixed with 9.84 parts of binder which was a mixture of about 9.35 parts of hot-melt polyamide and about 0.49 part of processing additive. The hot-melt polyamide was "Versalon" 1200 (General Mills) and was understood to have the following generalized formula:

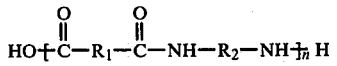

where $R_1$ is the residue of one or more dibasic acids, $R_2$ is the residue of one or more diamines and n is an integer such that the hot-melt polyamide has a ball-and-ring softening temperature of 200° C. It reportedly has a specific gravity of 0.99 and a viscosity (Brookfield) at 240° C. of 40 poises and at 200° C. of 80 poises.

The processing additive was believed to be a cyclic nitrile derivative of a saturated fatty acid dimer and to have the generalized formula $C_{36}H_{66}N_2$. Its specific formula may be

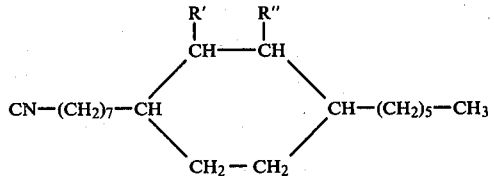

wherein one of R′ and R″ is alkyl and the other is —RCN, R being alkyl. It is believed that one is $-(CH_2)_7CN$ and the other is $-(CH_2)_7CH_3$. Other isomers may also be present, for example, where R′ is $-(CH_2)_{10}CN$ and R″ is $-(CH_2)_4CH_3$.

A mixture of about 95 parts of said hot-melt polyamide and 5 parts of said processing additive is currently available from General Mills as "TPX-954." The mixture had a ball-and-ring softening temperature of 190°–200° C. and a reported viscosity (Brookfield) at 210° C. of 25–55 poises.

The mixture of ferrite platelets and binder was charged to a banbury mixer and run through four speeds until the temperature reached 180° C., at which point it was immediately sheeted out on a roll mill to a thickness of about 0.6 cm. The sheet was cut into pieces which were chilled to −25° C., ground to particles 0.3 cm or smaller and fed into an injection molding machine (an Arburg Allrounder 221E/150R) under the following conditions:

| | |
|---|---|
| Machine injection pressure | 1400 psi (98kg/cm²) |
| Machine hold pressure | 300 psi (21kg/cm²) |
| Injection speed | maximum |
| Machine temperature levels | |
| Feed | 205° C. |
| Meter | 220° C. |
| Nozzle | 232° C. |
| Rectangular die cavity size | |
| In injection direction | 14 cm |
| Width | 2.5 cm |
| Thickness | 0.3 cm |

The die was water-cooled to a temperature of 15° C. and was subjected to a magnetic field of 12,000 oersteds in the thickness direction for 5 seconds during and after the injection. The injected material was ejected from the die after 30 seconds.

The magnetic values of the resultant magnet as determined using a recording hysteresis graph are tabulated below in comparison to a magnet which was made in the same way except for omission of the processing additive.

| | Example 1 | Comparative Magnet |
|---|---|---|
| $B_r$ gauss | 2705 | 2295 |
| $H_c$ oersteds | 2430 | 2300 |
| $H_{ci}$ oersteds | 4365 | 3965 |
| $BH_{max}$ gauss-oersteds | $1.8 \times 10^6$ | $1.2 \times 10^6$ |

The approximate particle alignment of the magnet of Example 1 was 95% and of the comparative magnet was 81.5%.

Apart from their different magnetic values, the comparative magnet and that of Example 1 appeared to have the same physical properties. The magnet of Example 1 had a tensile strength of about 300kg/cm² and an elongation at break of about 4% (ASTM D638-72).

Injection Temperature Study

The process of Example 1 was repeated except for adjustments in the temperature of the injection molding process with the following results:

| Meter Zone Temp. °C. | Br gauss |
|---|---|
| 163° | 2645 |
| 177° | 2670 |
| 190° | 2695 |
| 204° | 2705 |
| 232° | 2700 |
| 260° | 2695 |
| 274° | 2680 |
| 288° | 2645 |

Magnet Particle Volume Study

The process of Example 1 was repeated except for variations in the proportion of ferrite particles in the ferrite-binder mixture with the following results:

| Volume % Ferrite | $B_r$ gauss | $H_c$ oersteds | $H_{ci}$ oersteds |
|---|---|---|---|
| 61 | 2610 | 2380 | 4430 |
| 62 | 2610 | 2360 | 4340 |
| 63 | 2700 | 2390 | 4250 |

-continued

| Volume % Ferrite | $B_r$ gauss | $H_c$ oersteds | $H_{ci}$ oersteds |
|---|---|---|---|
| 64 | 2630 | 2360 | 4170 |

EXAMPLES 2–4

Matrix-bonded magnets were prepared from mixtures of the binder and barium ferrite particles used in Example 1 plus samarium-cobalt particles which had essentially equal axes and diameters primarily within the range of 40 to 70 micrometers. Each mixture comprised 63 volume percent particles and 37 volume percent binder. The mixtures were prepared on a steam-heated laboratory-size roll mill, broken up and then fed into a laboratory-size injection molding machine ("Quickshooter" Model QS-1), by which they were injected at about 290° C. into a cylindrical die cavity 1.9 cm in diameter in the injection direction and 0.3 cm in height. A field of about 13,000 oersteds was applied in the height direction. Tests on the resultant magnets are reported below.

| | Volume % | | | | | |
|---|---|---|---|---|---|---|
| Example | Barium Ferrite | $SmCo_5$ | Br gauss | Hc oer. | Hci oer. | BHmax $\times 10^6$ |
| 2 | 55 | 8 | 3240 | 2500 | 3750 | 2.34 |
| 3 | 36 | 27 | 4000 | 2900 | 5400 | 3.46 |
| 4 | 23 | 40 | 4480 | 3200 | 6400 | 4.1 |

Each of the magnets of Examples 2–4 had a particle alignment exceeding 90%.

What is claimed is:

1. Matrix-bonded permanent magnet comprising magnetically-hard, anisotropic particles in a nonmagnetic binder, which particles comprise at least 60 volume percent of the magnet and have an alignment exceeding 90%, said binder consisting essentially of hot-melt polyamide resin which is essentially amorphous and has a ball-and-ring softening temperature of at least 50° C. and a processing additive which is a cyclic nitrile derivative of a saturated fatty acid dimer, which additive comprises 1–35% by weight of the total binder.

2. Matrix-bonded permanent magnet as defined in claim 1 wherein said hot-melt polyamide has the generalized formula $$HO\left[\overset{O}{\overset{\|}{C}}-R_1-\overset{O}{\overset{\|}{C}}-NH-R_2-NH\right]_n H$$

wherein $R_1$ is the residue of one or more dibasic acids, $R_2$ is the residue of one or more diamines and n is an integer such that the hot-melt polyamide has a ball-and-ring softening temperature of at least 50° C.

3. Matrix-bonded permanent magnet as defined in claim 1 wherein said processing additive has the generalized formula $C_{36}H_{66}N_2$.

4. Matrix-bonded permanent magnet as defined in claim 3 wherein said processing additive comprises

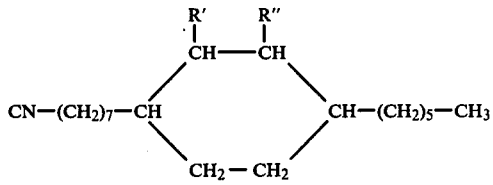

wherein one of R′ or R″ is —RCN, R being alkyl.

5. Matrix-bonded permanent magnet as defined in claim 4 wherein one of R′ is $-(CH_2)_7CN$ and the other is $-(CH_2)_7CH_3$.

6. Matrix-bonded permanent magnet as defined in claim 1 wherein said particles comprise barium ferrite particles.

7. Matrix-bonded permanent magnet as defined in claim 1 wherein said particles comprise samarium cobalt particles.

* * * * *